US011598514B2

(12) United States Patent
Chen et al.

(10) Patent No.: US 11,598,514 B2
(45) Date of Patent: Mar. 7, 2023

(54) DOWNLIGHT APPARATUS

(71) Applicant: XIAMEN LEEDARSON LIGHTING CO., LTD, Fujian (CN)

(72) Inventors: Jinfu Chen, Fujian (CN); Zhenyu Tang, Fujian (CN); Shuxing Gao, Fujian (CN); Yongzhe Dong, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/387,650

(22) Filed: Jul. 28, 2021

(65) Prior Publication Data

US 2022/0034495 A1 Feb. 3, 2022

(30) Foreign Application Priority Data

Jul. 28, 2020 (CN) ..... 202021522219.5
Jul. 28, 2020 (CN) ..... 202021522585.0
Jul. 28, 2020 (CN) ..... 202021523582.9

(51) Int. Cl.
*F21V 21/30* (2006.01)
*F21S 8/02* (2006.01)
*F21V 31/00* (2006.01)

(52) U.S. Cl.
CPC ..... *F21V 21/30* (2013.01); *F21S 8/026* (2013.01); *F21V 31/005* (2013.01)

(58) Field of Classification Search
CPC ..... F21V 21/30; F21V 31/005; F21S 8/026
See application file for complete search history.

(56) References Cited

U.S. PATENT DOCUMENTS 5,289,358 A * 2/1994 Halemeier ..... F21V 21/30 362/419
5,609,408 A * 3/1997 Targetti ..... F21V 21/30 362/523
6,132,062 A * 10/2000 Borders ..... F21S 8/046 362/426
10,247,390 B1 * 4/2019 Kopitzke, IV ..... F21V 14/02
10,697,599 B1 * 6/2020 Davis ..... F21V 21/30
10,851,971 B1 * 12/2020 Huang ..... F21V 31/005
11,105,496 B1 * 8/2021 Huang ..... F21V 17/105
11,215,345 B2 * 1/2022 Maghnagi ..... F21S 8/026
2014/0233246 A1 * 8/2014 Lafreniere ..... F21S 8/026 362/382
2015/0211708 A1 * 7/2015 Stavely ..... G02B 3/0056 362/231
2015/0276190 A1 * 10/2015 Devlin ..... F21V 21/30 362/362

(Continued)

*Primary Examiner* — Tsion Tumebo
(74) *Attorney, Agent, or Firm* — Chun-Ming Shih; Lanway IPR Services

(57) ABSTRACT

A downlight apparatus includes a base housing, a light module and a rotation shaft. The base housing has an inner hemisphere surface. The light module has an exterior hemisphere surface. The light module has a light source emitting a light. The rotation shaft has a first end fixed to the light module. The base housing has a shaft hole for the rotation shaft to pass through and rotate in the shaft hole. The rotation shaft has a second end attached to the base housing. A rotation axis of the rotation shaft is aligned with a radial direction of the exterior hemisphere surface for changing a light direction of the light by rotating the light module along the rotation shaft.

19 Claims, 7 Drawing Sheets

(56) References Cited

U.S. PATENT DOCUMENTS

| | | | | |
|---|---|---|---|---|
| 2016/0186967 | A1* | 6/2016 | Mathews | F21V 21/30<br>362/372 |
| 2019/0063724 | A1* | 2/2019 | Vice, Jr. | F21V 17/12 |
| 2019/0063736 | A1* | 2/2019 | Zeng | F21V 21/30 |
| 2020/0224857 | A1* | 7/2020 | Liang | F21V 5/04 |

* cited by examiner

DOWNLIGHT APPARATUS

FIELD

The present invention is related to a downlight apparatus, and more particularly related to a downlight apparatus with a rotation design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Downlight devices are widely used in various locations. Usually, two torsion springs or elastic bars are used for fixing downlight devices in a cavity or an junction box on a ceiling.

Most time, downlight devices emit lights in a static direction. To change a light direction of a downlight device, the downlight may have a complicated structure, which causes increase of manufacturing cost.

Therefore, it is beneficial to provide a simple design that still provides certain light direction adjustment.

SUMMARY

In some embodiments, a downlight apparatus includes a base housing, a light module and a rotation shaft.

The base housing has an inner hemisphere surface.

The light module has an exterior hemisphere surface.

The light module has a light source emitting a light.

The rotation shaft has a first end fixed to the light module.

The base housing has a shaft hole for the rotation shaft to pass through and rotate in the shaft hole.

The rotation shaft has a second end attached to the base housing.

A rotation axis of the rotation shaft is aligned with a radial direction of the exterior hemisphere surface for changing a light direction of the light by rotating the light module along the rotation shaft.

In some embodiments, the base housing has a rim surface defining a module opening.

The rotation axis has a tilt angle relative to the rim surface.

The tilt angle is between 5 degrees to 85 degrees.

In some embodiments, the tilt angle is between 30 degrees to 75 degrees.

In some embodiments, a limiting unit is disposed used for limiting a rotation angle of the rotation shaft.

In some embodiments, the limiting unit is a protruding unit disposed on the second end of the rotation shaft moved in a limiting area defined by the base housing.

In some embodiments, an exterior side of the base housing has a block for defining the limiting area.

In some embodiments, a sealing ring is placed on the rotation shaft for increasing a friction and preventing water to enter the light module.

In some embodiments, a rubber ring is disposed on the rotation shaft for inserting the power wire to tightly engaging the power wire for preventing water to enter the rotation shaft.

In some embodiments, the rotation shaft has a wire hole for inserting a power wire from an exterior side of the base housing to the light module to provide a power to the light source.

In some embodiments, the light module has a module plugging unit for attaching to the power wire.

In some embodiments, the power wire is kept outside the light module.

In some embodiments, the first end of the rotation shaft is fixed on the module plugging unit.

In some embodiments, the light module has a rotation handle for a user to hold the rotation handle to rotate the light module with respect to the base housing along the rotation shaft.

In some embodiments, the handle has a manual switch for adjusting a light parameter of the light source.

In some embodiments, the light module has a lens.

The handle is placed on the lens for rotating the lens with respect to the light source to adjust a relative distance of the lens to the light source to change a output light pattern of the light via the lens.

In some embodiments, the light source is turned off automatically when the handle is moved to rotate the light module for a predetermined time period.

In some embodiments, the light module has a light source plate and a lens.

The lens has an inner wall pressing on the light source plate and surrounding the light source.

In some embodiments, the lens has a lens rim buckled to a module rim of the light module.

In some embodiments, a driver and the light source are disposed on opposite sides of the light source plate.

In some embodiments, an exterior side of the base housing has two wing bracket for respectively disposing two elastic wings for fixing to a platform.

DETAILED DESCRIPTION

Figure 7:
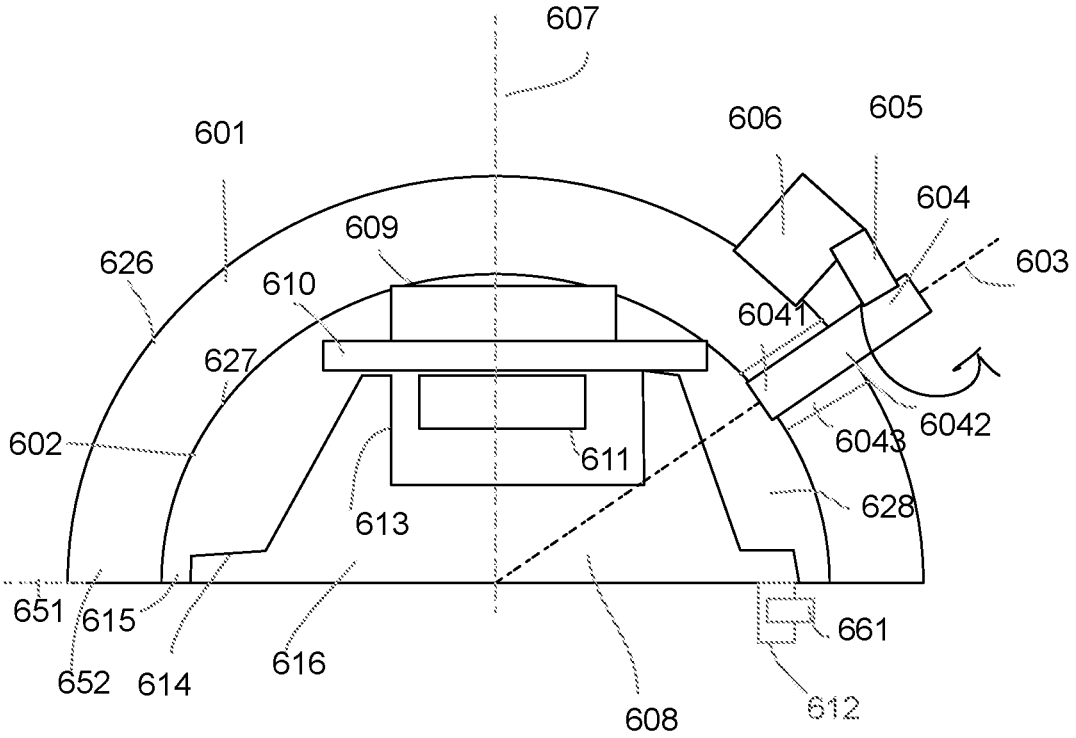
FIG. 7 shows another downlight apparatus.

Please refer to FIG. 7. In FIG. 7, a downlight apparatus includes a base housing 601, a light module 628 and a rotation shaft 604.

The base housing 601 has an inner hemisphere surface 626.

The light module 628 has an exterior hemisphere surface 627. The exterior hemisphere surface 627 is smaller than the inner hemisphere surface 626 and is movable inside the inner hemisphere surface 626.

The light module 628 has a light source 611 emitting a light. For example, the light source 611 may include one or multiple LED modules with the same type or different types to mix a required light output.

The rotation shaft 604 has a first end 6041 fixed to the light module 628.

The base housing 601 has a shaft hole 6043 for the rotation shaft 604 to pass through and rotate in the shaft hole 6043.

The rotation shaft 604 has a second end 6042 attached to the base housing 601.

A rotation axis 603 of the rotation shaft 603 is aligned with a radial direction of the exterior hemisphere surface 627 for changing a light direction of the light by rotating the light module 628 along the rotation shaft 604. An example of such rotation may be found in the examples of FIG. 5 and FIG. 6.

In some embodiments, the base housing 601 has a rim surface 651 defining a module opening 652. The light module 628 is moved within the module opening 652.

The rotation axis 603 has a tilt angle 608 relative to the rim surface 651.

The tilt angle 608 is between 5 degrees to 85 degrees.

In some embodiments, the tilt angle 608 is between 30 degrees to 75 degrees. The tilt angle 608 determines a rotation pattern of the light module 628 with respect to the base housing 601.

In some embodiments, a limiting unit 605 is disposed used for limiting a rotation angle of the rotation shaft 604. For example, an extending bar is placed on the rotation shaft 604 so that when the extending bar engages a protruding block 606, the rotation shaft 604 is stopped by the limiting unit 605.

In some embodiments, the limiting unit is a protruding unit disposed on the second end of the rotation shaft moved in a limiting area defined by the base housing, as shown in FIG. 7.

In some embodiments, an exterior side of the base housing has a protruding block 606 for defining the limiting area, e.g. to stop the rotation shaft 604 to rotate more than 180 degrees to twist the a power wire.

Figure 8:
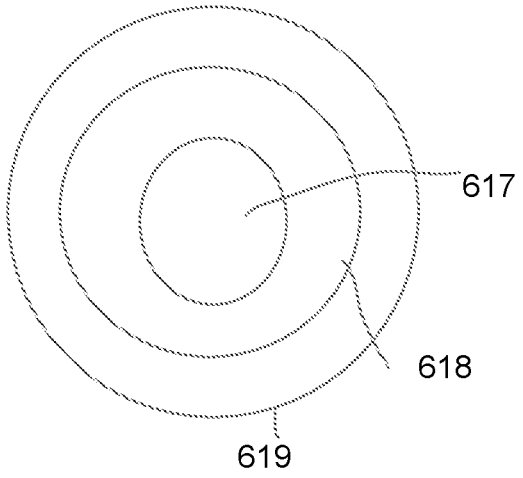
FIG. 8 shows a concealing ring example.

In FIG. 8, a sealing ring 619 is placed on the rotation shaft 618 for increasing a friction and preventing water to enter the light module.

In some embodiments, a rubber ring 617 is disposed on the rotation shaft 618 for inserting the power wire to tightly engaging the power wire for preventing water to enter the rotation shaft 618. For example, the rotation shaft 618 is a tubular structure and a power wire is inserted into the rotation shaft 618 to the light module. The rubber ring 617 tightly enclose the inserted power wire to prevent water to move into the light module.

The concealing ring 619 on the other side is also used for preventing water to enter the inner part of the light device.

Figure 9:
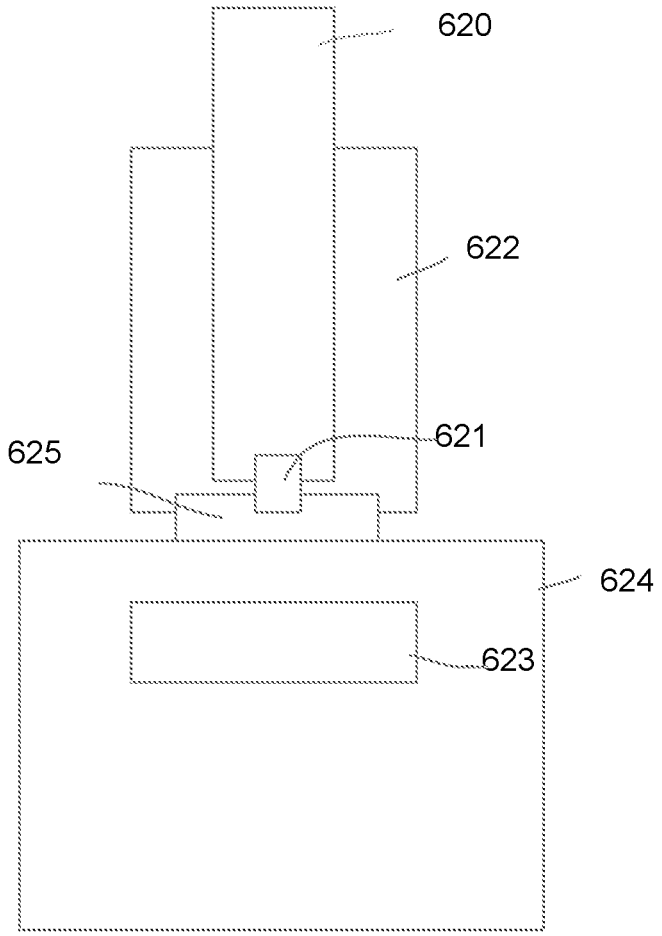
FIG. 9 shows a connection for a rotation shaft.

In FIG. 9, the rotation shaft 622 has a wire hole for inserting a power wire 620 from an exterior side of the base housing to the light module 624 to provide a power to the light source 623.

In FIG. 9, the light module has a module plugging unit 621 for attaching to the power wire 620.

In some embodiments, the power wire 620 is kept outside the light module 624. Such The plugging unit 621 like a socket is used for keeping the power wire 620 outside the light module 624 while still providing electricity to the light source 623.

In some embodiments, the first end of the rotation shaft 622 is fixed on a structure connector 625 of the module plugging unit 621.

In FIG. 7, the light module has a rotation handle 612 for a user to hold the rotation handle 612 to rotate the light module 628 with respect to the base housing 601 along the rotation shaft 604.

In some embodiments, the rotation handle 612 has a manual switch 661 for adjusting a light parameter of the light source 611. For example, a push button or a rotation switch may be added as the manual switch 661 to indicate a driver 609 to change a setting of the light source 611.

In some embodiments, the light module 628 has a lens 616.

The rotation handle 612 is placed on the lens 616 for rotating the lens 616 with respect to the light source 611 to adjust a relative distance of the lens 616 to the light source 611 to change a output light pattern of the light via the lens 616. For example, the rotation handle 612 rotates the lens 616 with respect to the light source to change a relative distance by arranging a screw groove to convert a rotation by the rotation handle 612 to a distance changing between the lens 616 and the light source 611.

In some embodiments, the light source 611 is turned off automatically when the rotation handle 612 is moved to rotate the light module 628 for a predetermined time period.

Such design prevent electric shock when users are adjusting the setting with the rotation handle 612.

In some embodiments, the light module has a light source plate 610 and a lens 616.

The lens 616 has an inner wall 613 pressing on the light source plate 610 and surrounding the light source 611.

In some embodiments, the lens 616 has a lens rim 614 buckled to a module rim 615 of the light module 628. In other words, the lens 616 has one end pressing the light source plate 610 and the other end pressing the module rim 615.

In some embodiments, a driver 609 and the light source 611 are disposed on opposite sides of the light source plate 610.

In some embodiments, an exterior side of the base housing has two wing bracket for respectively disposing two elastic wings for fixing to a platform.

Figure 2:
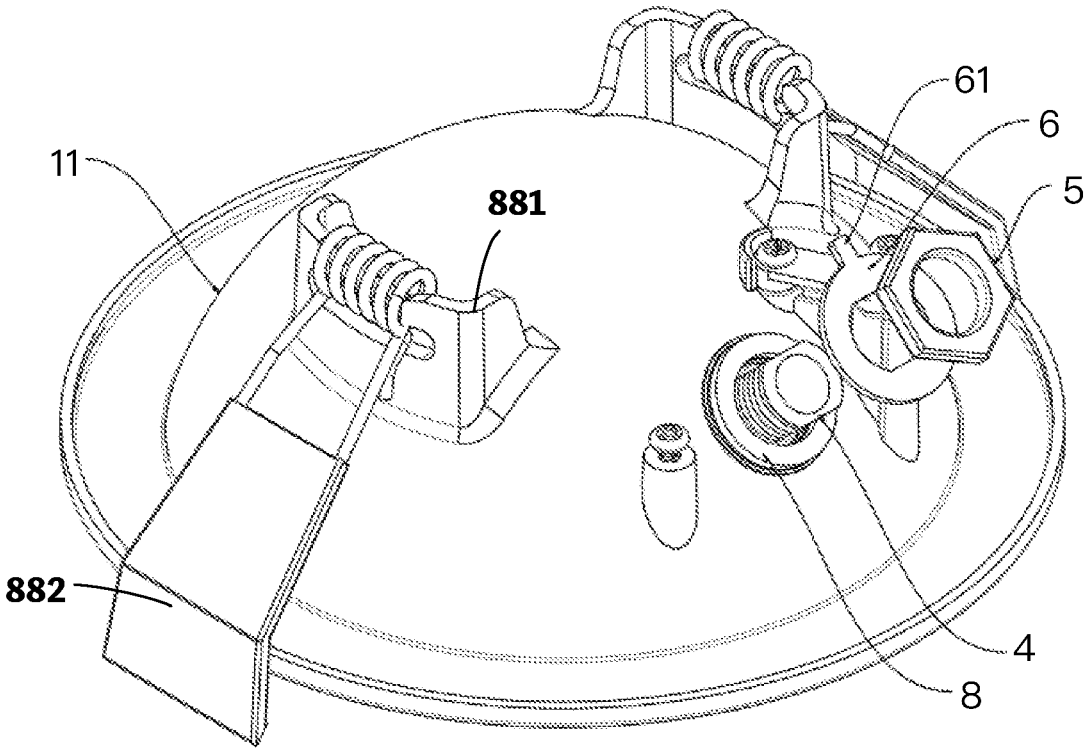
FIG. 2 illustrates a top view of the example in FIG. 1.

For example, FIG. 2 shows a wing bracket 881 attaching an elastic wing 882 to be fixed to a ceiling or a junction box platform.

Figure 1:
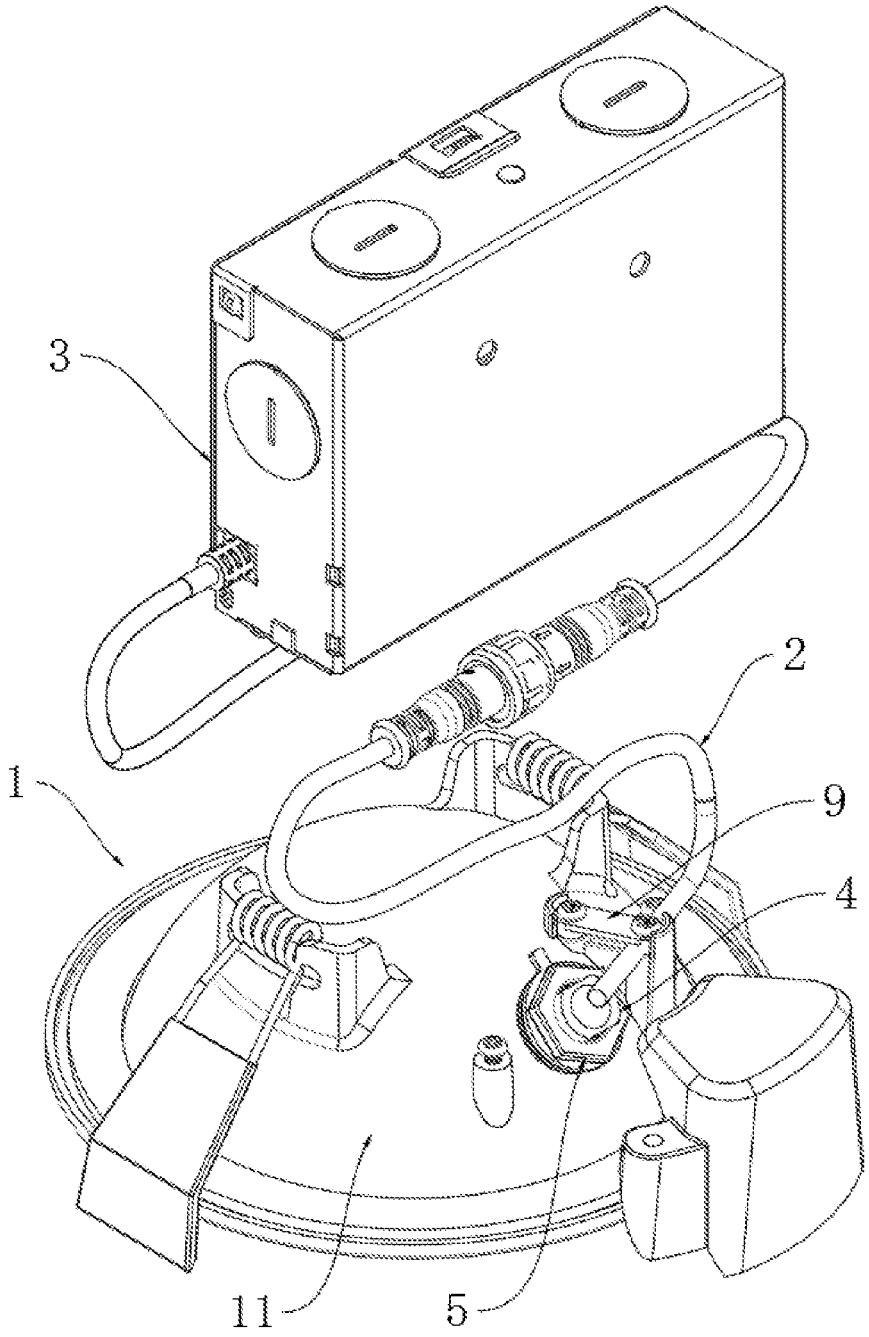
FIG. 1 illustrates a downlight apparatus embodiment.

Please refer to FIG. 1. FIG. 1 shows a downlight apparatus 1 that includes a driver 3.

The driver includes a driver circuit to convert an external power to a driving current. The generated driving current is supplied to a light source via a power wire 2.

The power wire 2 is inserted into a rotation shaft 4. The rotation shaft 4 has a screw ring 5 and is disposed on a base housing 11. There is a wire plate 9 for pressing the power wire 2 to keep the power wire 2 in a desired position.

Please continue refer to FIG. 2 to FIG. 6, which show different aspects of the example. The same reference numerals refer to the same components and may not be described again for brevity.

In FIG. 2, the rotation shaft 4 engages the screw ring 6, and a limiting unit 6 which has a protruding pin 61 that engages a protruding block on the base housing 11 to limit a rotation range of the rotation shaft 4. There is a concealing ring 8 to prevent water to enter the downlight apparatus.

Figure 3:
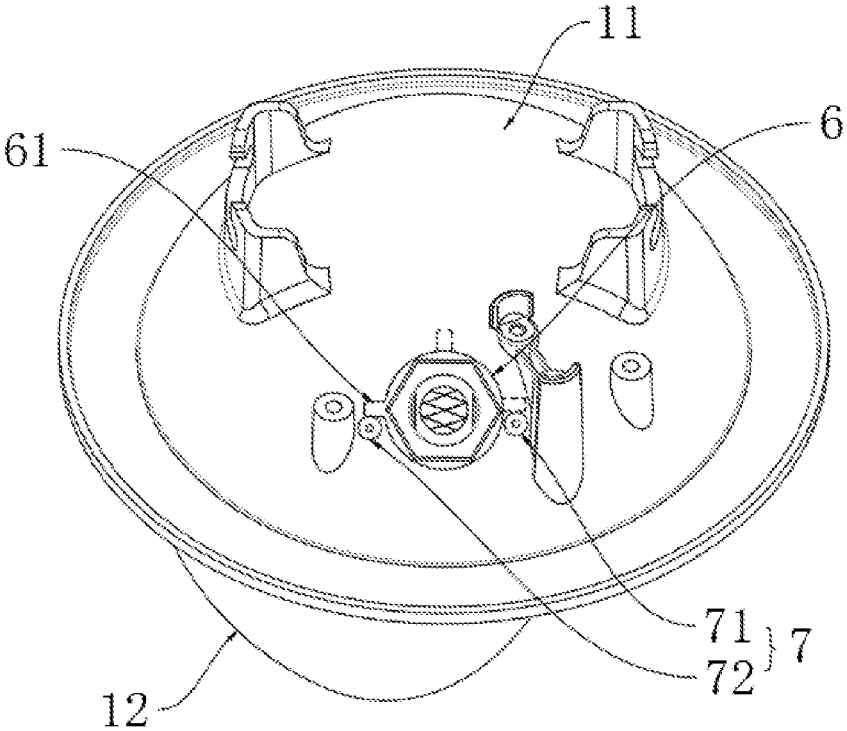
FIG. 3 illustrates a portion of the example in FIG. 1

In FIG. 3, two protruding blocks 71, 72 form a protruding unit 7 on the base housing 11 to limit a rotation of the rotation shaft when the protruding pin 61 of the limiting unit 6 engages the protruding blocks 71, 72.

Figure 4:
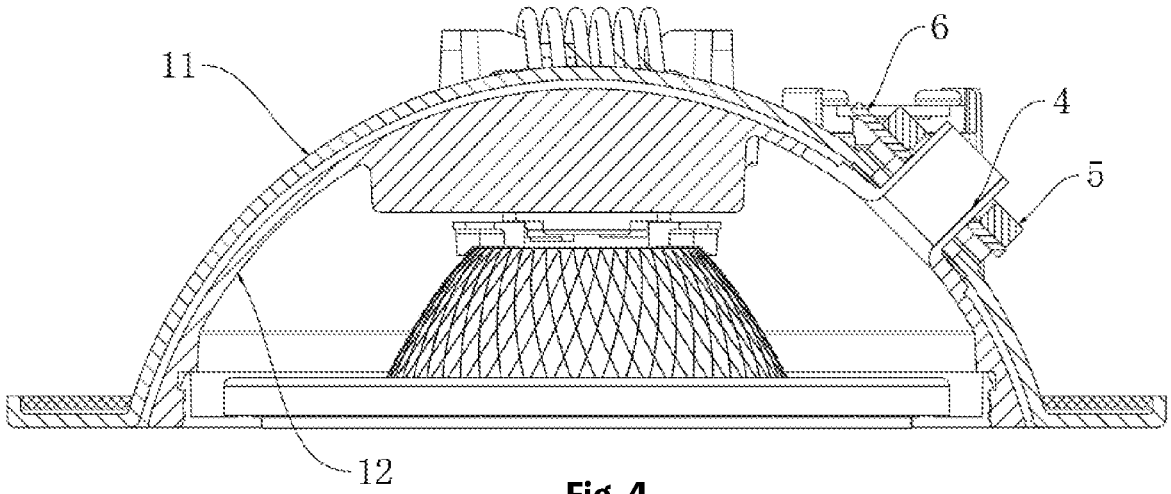
FIG. 4 illustrates a cross-sectional view of the example in FIG. 1.

FIG. 4 shows a cross-sectional view of the example in FIG. 1.

The light module 12 is attached partially inside the base housing 11 and may be rotated with respect to the base housing 11 with the rotation shaft 4.

Figure 5:
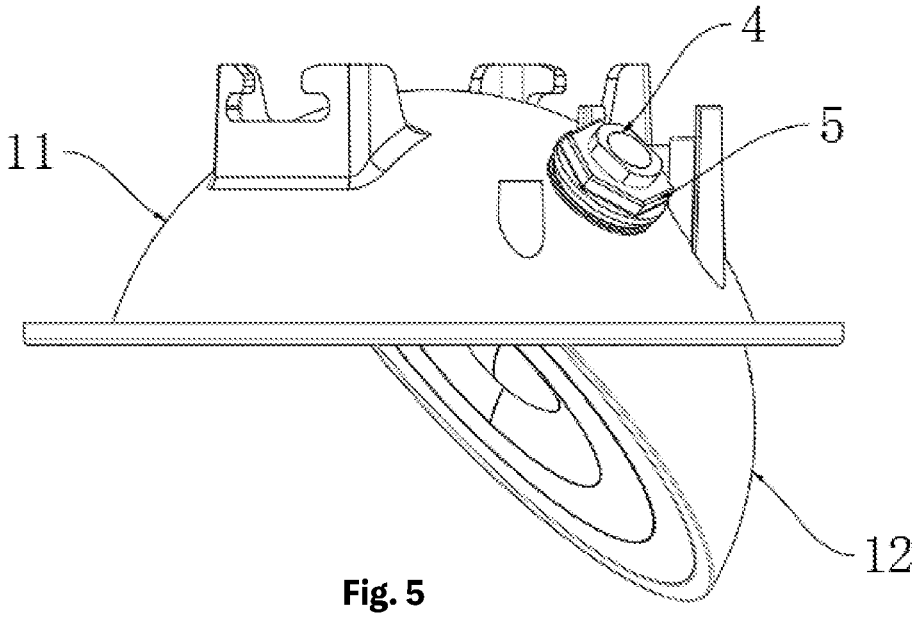
FIG. 5 illustrates a rotation example of the example in FIG. 1.
Figure 6:
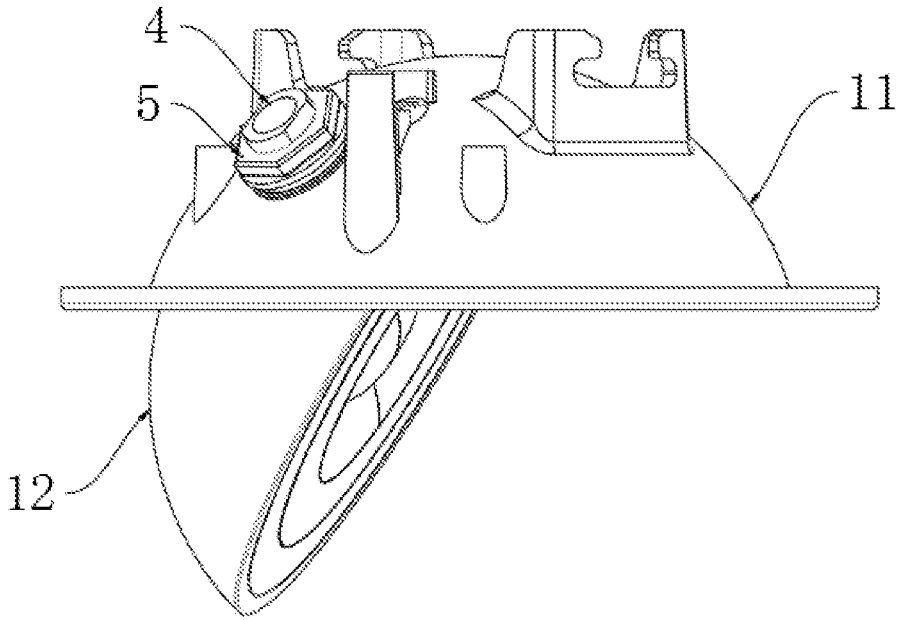
FIG. 6 illustrates another view of the rotation example in FIG. 5.

FIG. 5 and FIG. 6 shows a rotation example of the light module 12 with respect to the base housing 11.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a base housing with an inner hemisphere surface;

a light module with an exterior hemisphere surface, wherein the light module has a light source emitting a light; and a rotation shaft with a first end fixed to the light module, wherein the base housing has a shaft hole for the rotation shaft to pass through and rotate in the shaft hole, wherein the rotation shaft has a second end attached to the base housing, wherein a rotation axis of the rotation shaft is aligned with a radial direction of the exterior hemisphere surface of the base housing for changing a light direction of the light by rotating the light module along the rotation shaft, wherein the base housing has a rim surface defining a module opening, wherein the rotation axis has a tilt angle relative to the rim surface, wherein the tilt angle is between 5 degrees to 85 degrees.

2. The downlight apparatus of claim 1, wherein the tilt angle is between 30 degrees to 75 degrees.

3. The downlight apparatus of claim 1, wherein a limiting unit is disposed used for limiting a rotation angle of the rotation shaft.

4. The downlight apparatus of claim 3, wherein the limiting unit is a protruding unit disposed on the second end of the rotation shaft moved in a limiting area defined by the base housing.

5. The downlight apparatus of claim 4, wherein an exterior side of the base housing has a block for defining the limiting area.

6. The downlight apparatus of claim 1, wherein a sealing ring is placed on the rotation shaft for increasing a friction and preventing water to enter the light module.

7. The downlight apparatus of claim 1, wherein a rubber ring is disposed on the rotation shaft for inserting the power wire to tightly engaging the power wire for preventing water to enter the rotation shaft.

8. The downlight apparatus of claim 1, wherein the rotation shaft has a wire hole for inserting a power wire from an exterior side of the base housing to the light module to provide a power to the light source.

9. The downlight apparatus of claim 8, wherein the light module has a module plugging unit for attaching to the power wire.

10. The downlight apparatus of claim 9, wherein the power wire is kept outside the light module.

11. The downlight apparatus of claim 9, wherein the first end of the rotation shaft is fixed on the module plugging unit.

12. The downlight apparatus of claim 1, wherein the light module has a rotation handle for a user to hold the rotation handle to rotate the light module with respect to the base housing along the rotation shaft.

13. The downlight apparatus of claim 12, wherein the handle has a manual switch for adjusting a light parameter of the light source.

14. The downlight apparatus of claim 12, wherein the light module has a lens, wherein the handle is placed on the lens for rotating the lens with respect to the light source to adjust a relative distance of the lens to the light source to change a output light pattern of the light via the lens.

15. The downlight apparatus of claim 12, wherein the light source is turned off automatically when the handle is moved to rotate the light module for a predetermined time period.

16. The downlight apparatus of claim 1, wherein the light module has a light source plate and a lens, wherein the lens has an inner wall pressing on the light source plate and surrounding the light source.

17. The downlight apparatus of claim 16, wherein the lens has a lens rim buckled to a module rim of the light module.

18. The downlight apparatus of claim 16, wherein a driver and the light source are disposed on opposite sides of the light source plate.

19. The downlight apparatus of claim 1, wherein an exterior side of the base housing has two wing bracket for respectively disposing two elastic wings for fixing to a platform.

* * * * *